United States Patent [19]

Stefanini

[11] Patent Number: 4,667,960

[45] Date of Patent: May 26, 1987

[54] MULTIPLE MAZE GAME

[76] Inventor: Giancarlo Stefanini, 90 Yorkleigh Avenue, Toronto, Ontario, Canada, M9P 1Y7

[21] Appl. No.: 719,404

[22] Filed: Apr. 3, 1985

[51] Int. Cl.[4] ..... A63F 9/08

[52] U.S. Cl. ..... 273/153 R; 273/1 GB; 368/10

[58] Field of Search ..... 273/153 R, 1 GB; 368/3, 368/10

[56] References Cited

U.S. PATENT DOCUMENTS

| | | | |
|---|---|---|---|
| 2,011,266 | 8/1935 | Boynton | 273/153 R |
| 3,829,088 | 8/1974 | Pahlas | 273/1 GB |
| 4,106,773 | 8/1978 | Coefield | 273/272 X |
| 4,451,156 | 5/1984 | Kloppsteck | 368/10 |

FOREIGN PATENT DOCUMENTS

| | | | |
|---|---|---|---|
| 653661 | 12/1962 | Canada | 273/153 R |
| 637124 | 12/1978 | U.S.S.R. | 273/153 R |

*Primary Examiner*—Anton O. Oechsle

*Attorney, Agent, or Firm*—Rogers, Bereskin & Parr

[57] ABSTRACT

A maze game including upper and lower discs which are turnable with respect to one another and which have arrays of wall elements at their inner surfaces for defining paths through the maze in different relative angular positions of the discs. At least the upper disc is transparent and a metallic playing piece can be manipued through the maze using a wand having a magnetic tip which is drawn across the upper surface of the top disc.

7 Claims, 10 Drawing Figures

MULTIPLE MAZE GAME

BACKGROUND OF THE INVENTION

1. Field of the Invention

This invention relates generally to games and is concerned in particular with games of the type which include a maze and in which the object of the game is to move a playing piece through the maze.

2. Description of the Prior Art

Various games of this general form have previously been proposed. Perhaps the simplest comprises a plastic moulded tray in which the maze is formed, and a transparent cover which forms a lid for the tray and which is sealed thereto so as to enclose the playing piece. The playing piece itself is usually a ball bearing or other spherical object and the game is played by manipulating the tray to cause the ball bearing to roll through the maze.

It has also been proposed to provide a maze game including a series of concentrically arranged annular members which can be turned about a common axis to provide different maze configurations. An example of this type of game is disclosed in U.S. Pat. No. 4,452,455 (Bergstrom et al.). In this case, the different maze patterns are formed randomly.

An object of the present invention is to provide a maze game having enhanced play appeal as compared with the prior art.

SUMMARY OF THE INVENTION

The game provided by the invention has a maze through which playing pieces can be moved between a central location and at least one location and includes upper and lower plates supported for relative turning movement in generally parallel planes about an axis generally at the said central location, and respective arrays of wall elements at inner surfaces of the plates co-operating to define the maze. The wall elements on one of the plates are arranged in spaced concentric annular rows about the said axis and the wall elements of the other plate extend generally radially between the annular rows of wall elements. The arrays of wall elements are arranged to define a plurality of different paths through the maze in respectively different relative positions of the plates about the said axis. At least the upper plate is transparent and the game also includes a playing piece and a wand to which the playing piece is magnetically attractable so that the playing piece can be manipulated through the maze by drawing the wand across the transparent upper plate.

It is believed that the game provided by the invention will have great play appeal in that different maze paths can be achieved by the simple expedient of effecting relative turning movement between the upper and lower plates, thereby presenting the player with a new challenge. In other words, as contrasted with prior art games having a fixed maze configuration, the game will not soon lose its play appeal because of a player having learned the path through the maze. In a practical embodiment of the invention, nine different maze paths were provided in the game. At the same time, it is believed that the game is of relatively simple construction and may be commercially manufactured at reasonable cost. For example, each of the plates and the associated array of wall elements may be provided by a single plastic moulding and the two mouldings may be designed to couple together for turning about the said axis.

Preferably, for added play appeal, both plates and the wall elements will be made of transparent material; it is believed that this will "confuse" the eye of a player and provide a greater challenge than if the lower plate and wall elements were opaque.

While it would be possible to arrange for either or both of the upper and lower plates to be turned to provide the different maze configurations, the preferred arrangement is to allow the lower plate to remain stationary and turn the upper plate. The lower plate can then be provided with feet or other means for supporting the game on a table or other playing surface.

Detent means are preferably provided for locating the plates with respect to one another in the predetermined relative positions in which the different maze paths are defined. The detent means may take the form of a resilient latch or "finger" on one of the plates engageable in complimentary recesses in the other plate, for defining the different relative positions of the plates.

BRIEF DESCRIPTION OF THE DRAWINGS

In order that the invention may be more clearly understood, reference will now be made to the accompanying drawings which illustrate preferred embodiments of the invention by way of example, and in which.

DESCRIPTION OF PREFERRED EMBODIMENTS

Figure 1:
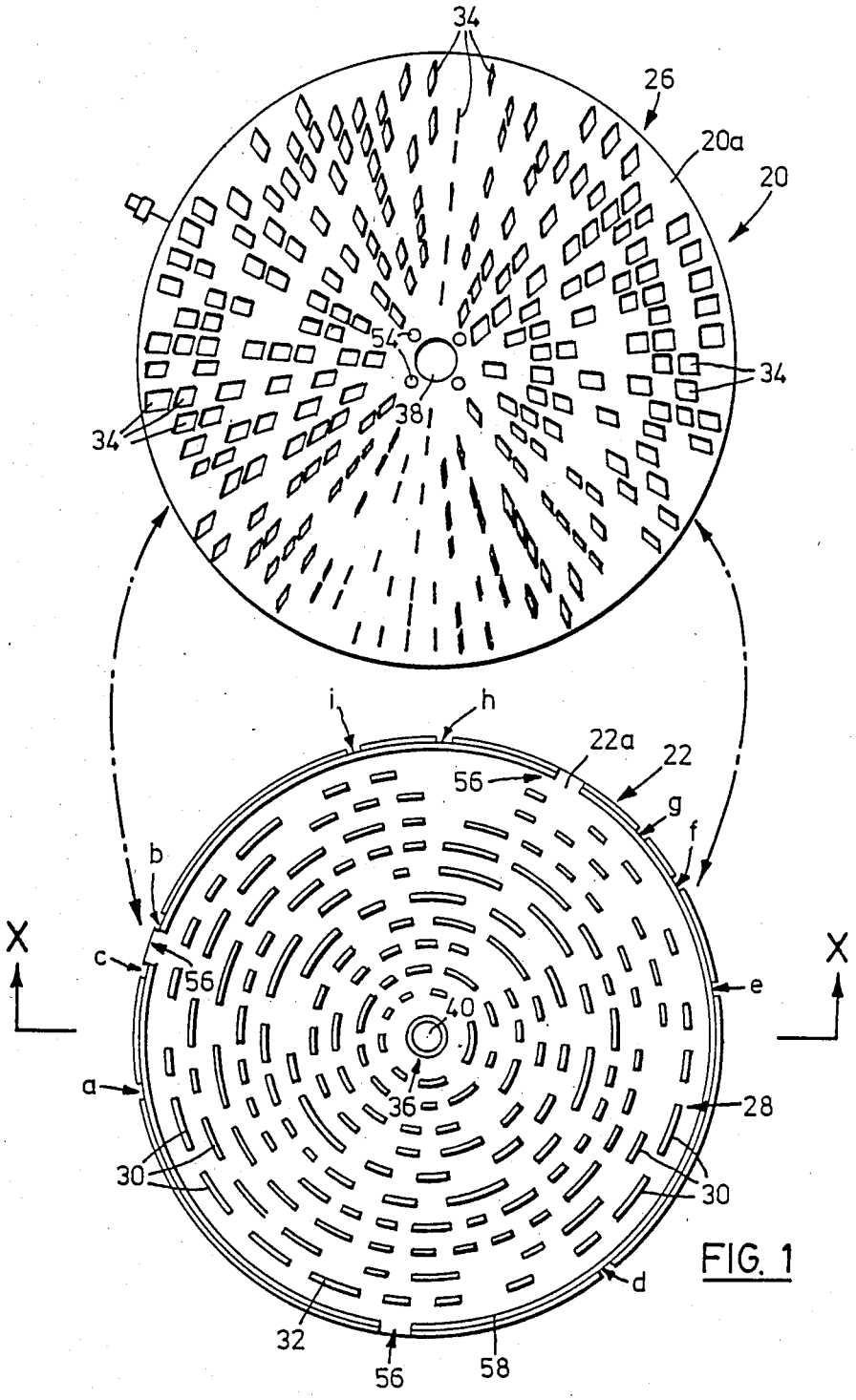
FIG. 1 is an exploded elevational view of the upper and lower plates of the game, showing the inner surfaces of the plates carrying the arrays of wall elements.
Figure 2:
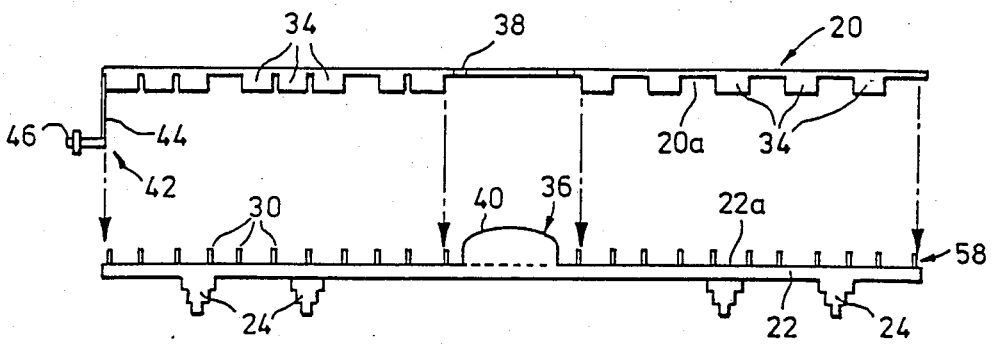
FIG. 2 is a vertical sectional view on line X—X of FIG. 1 with the two plates spaced apart preparatory to final assembly of the game.
Figure 3:
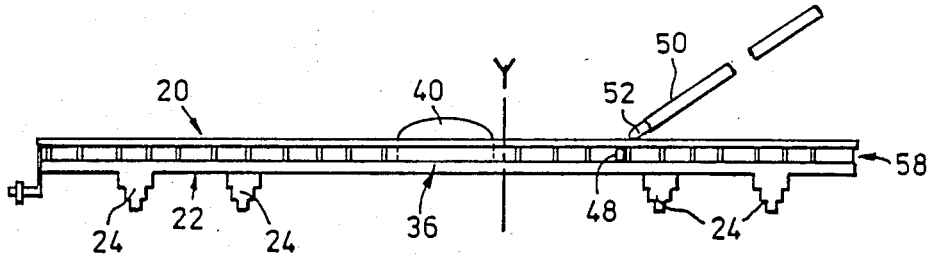
FIG. 3 is a view similar to FIG. 2 showing the assembled game.

Referring first to FIG. 1, the game includes respective upper and lower plates 20 and 22 which are shown separated from one another with the inner surfaces **20*a* and 22*a* respectively of the plates visible. In this embodiment, the two plates are plastic discs of the same diameter. In the assembled game, the upper plate 20 is inverted and the two plates are assembled together as shown in FIGS. 2 and 3 with the centers of the two discs coincident and defining an axis C—C about which the upper disc can turn with respect to the lower disc. As best seen in FIGS. 2 and 3, the lower disc is provided with integrally mouled plastic "feet" 24** for supporting the game on a surface.

Figure 4:
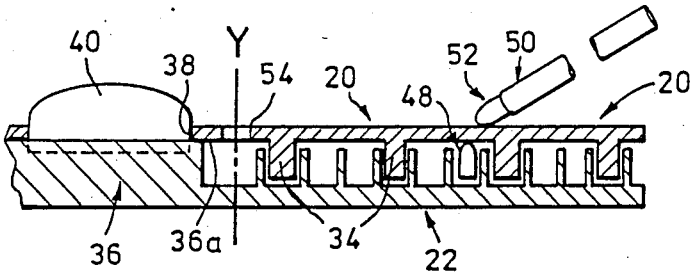
FIG. 4 is an enlarged detail view of part of FIG. 3.

Referring back to FIG. 1, the discs 20 and 22 are provided on their inner surfaces with respective arrays of wall elements generally denoted respectively 26 and 28. When the two discs are assembled together as discussed previously, the wall elements co-operate to define the maze. In this embodiment, the wall elements on the lower disc 22 are arranged in spaced concentric annular rows about the center of the disc. Some of the wall elements on disc 22 are individually denoted by reference numberal 30 while some of the annular rows are indicated in chain dotted line at 32. The wall elements in the array 26 on disc 20 on the other hand extend generally radially and are arranged to fit between the annular rows of wall elements in the array 28 on disc 22 when the two discs are assembled together. Some of the wall elements in array 26 are individually denoted 34. As shown in FIG. 1, the wall elements in array 26 are seen in perspective, as a result of which some of the elements appear as thin lines while others are drawn as rectangular in shape. In fact, all of the wall elements in array 26 are in the nature of thin rectangular fins or tabs projecting from the inner surface of plate 20. The wall elements in array 28 on plate 20 are essentially the same except they are arcuately curved as seen in plan. FIG. 4 best illustrates the co-operation between the respective arrays of wall elements and shows some of the elements 34 on plate 20 positioned between the rows of wall elements 30 on plate 22. FIG. 2 also shows some of the wall elements 34 in elevation and some of the wall elements 30 in section.

FIG. 4 also shows the relationship between the two plates 20 and 22 in the assembled condition of the game and illustrates the fact that clearance exists between the wall elements in the respective arrays so as to permit turning movement of the upper disc 20 with respect to the lower disc 22. This is achieved by providing a boss 36 at the center of the lower disc 22 and a complementary opening 38 in the upper disc for receiving the boss. The boss is shaped to define a shoulder 36*a* on which the portion of the upper disc surrounding opening 38 rests in the assembled game. In this particular embodiment, a timer generally indicated at 40 is provided as part of boss 36 and protrudes through the upper disc so that it accessible from externally of the game. Details of the timer 40 have not been given since the timer itself will be conventional. It may, for example, be a mechanical or electronic timer. The intention is that the timer can be set to provide different time periods in which to complete movement of a playing through the maze, for providing an added element of competition in using the game. However, timer 40 is not essential within the broad scope of the invention.

Figure 5:
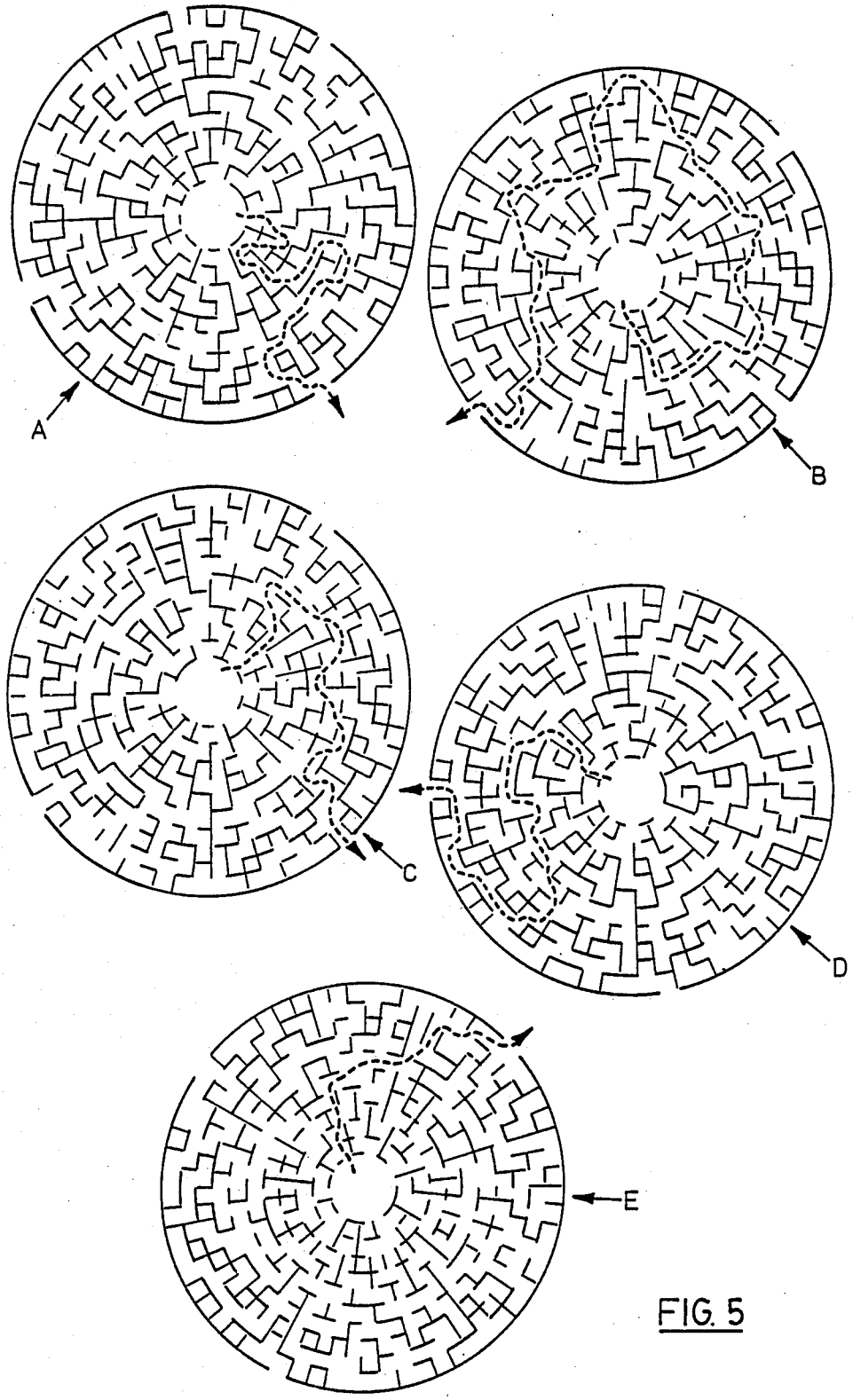
FIG. 5 comprises five schematic illustrations of different maze paths throught the game.
Figure 6:
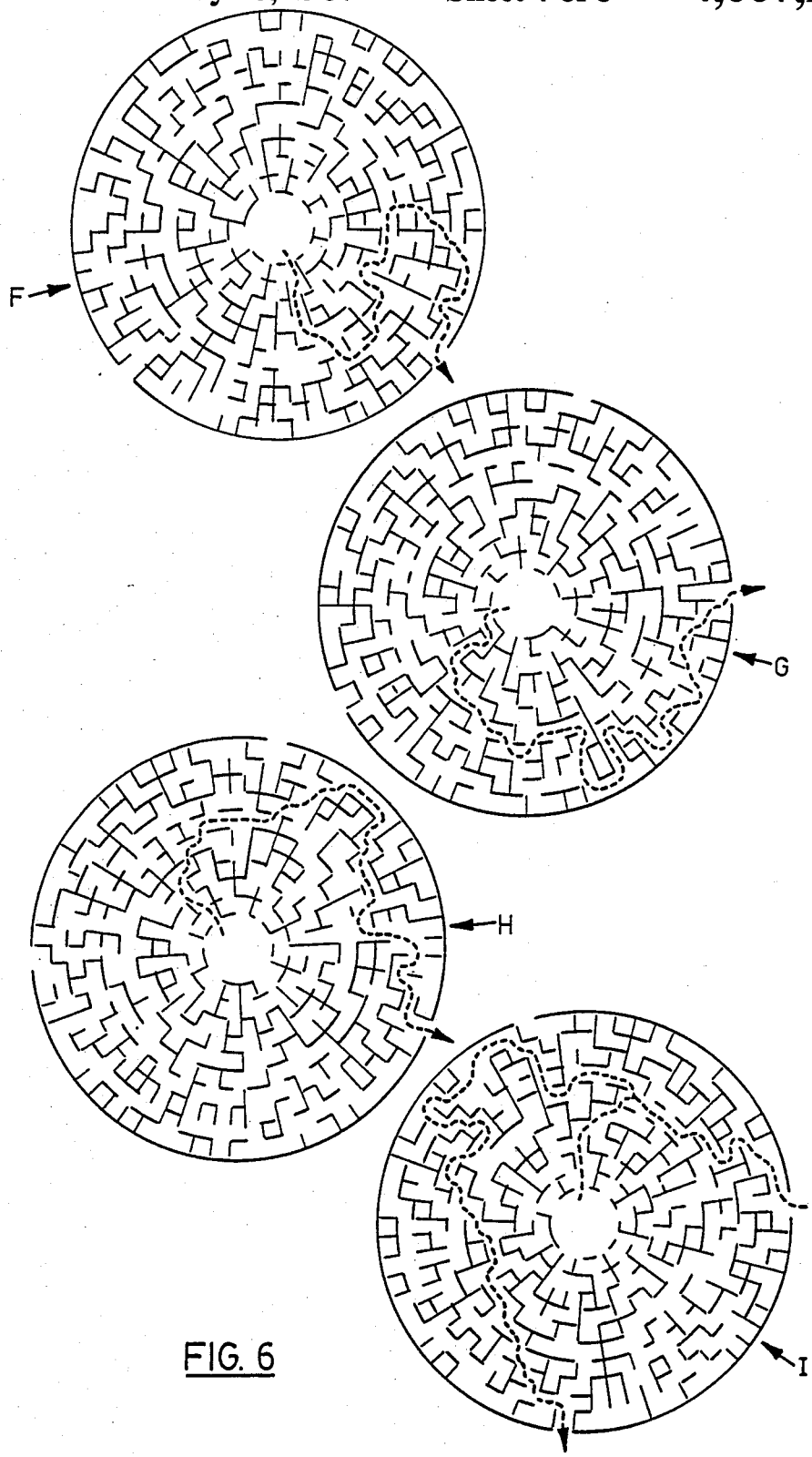
FIG. 6 is a view similar to FIG. 5 showing four additional paths.

The wall elements 30 and 34 in the respective arrays 28 and 26 respectively are arranged in predetermined positions on their respective discs to define a plurality of different paths through the maze in respective different predetermined relative positions of the two discs with respect to one another. FIGS. 5 and 6 together show nine different maze paths actually provided in a maze game constructed in accordance with the invention. Those maze paths are achieved by positioning the wall elements on the respective discs 20 and 22 so that the elements co-operate to form defined paths in different relative angular positions of the discs. The wall elements on each disc are fixed and each disc may in fact be a unitary plastic moulding, preferably in a transparent material as discussed above.

In this embodiment, the nine maze configurations shown in FIGS. 5 and 6 are achieved by turning the upper disc 20 of the game with respect to the lower disc (which remains stationary). The relative positions of the discs are determined by detent means comprising a latch member, generally denoted 42 in FIGS. 1, 2 and 3, which is moulded as part of the upper disc 20 and is arranged to engage in one of a series of complementary recesses in the periphery of the lower disc 22. As best seen in FIG. 2, latch 42 includes a flexible stem or "finger" 44 which extends downwardly from disc 20 and then turns outwardly to a knob 46. Knob 46 can be grasped and pulled outwardly to deflect finger 44 to release the finger from a particular recess in disc 22 when the upper disc is to be turned with respect to the lower disc.

In FIG. 1, the recesses in the periphery of the lower disc 22 are individually denoted by the letters "a" to "i". In FIGS. 5 and 6, the corresponding maze paths defined by engagement of latch 42 in the recesses "a" to "i" are indicated by "A" to "I".

In summary, all a player has to do to achieve a different maze configuration is to release the latch 42 from the recess in which happens to lie at that time, by pulling the knob 46 outwardly, and then turn the upper disc 20 until rhe latch drops into the next, or another recess in disc 22. The stem or finger 44 of latch 42 is resilient and always tends to adopt the configuration shown in FIG. 2 so that it will tend to naturally drop into the next recess unless the knob 46 is held.

FIGS. 3 and 4 also show a playing piece 48 and a corresponding wand 50 used in playing the game. Wand 50 has a magnetic tip 52 while the playing piece 48 is a bullet-shaped piece of ferromagnetic material and is therefore attracted to the magnetic tip 52 of wand 50. Accordingly, by moving the wand 50 so that its tip traces a path on the top surface of disc 20, a playing piece 48 will follow the tip and can be manipulated through the maze. Tip 52 has a non-scratch surface.

Playing piece 48 is inserted into and removed from the maze through openings 54 in disc 20 adjacent the center of the disc and openings 56 (FIG. 1) at the perimeter of the lower disc 22. Thus, it will be seen that disc 22 has a perimeter "wall" 58 outwardly of the wall elements 30 with gaps in the wall representing the openings 56. The perimeter wall 58 is the same height as the wall elements and therefore effectively closes the space between the two discs 20 and 22 around the perimeter of the game except at the locations 56. Part of the perimeter wall 58 is visible in FIGS. 2 and 4. It will be seen from FIG. 1 that, in this embodiment, there are four openings 54 adjacent the center of the top disc 20 and three openings 56 at the perimeter of the game. However, there is no limitation to this particular number of openings. Normally, the game will be played by inserting the playing piece through one of the openings 54 adjacent the center of the game and manipulating the playing piece to one of the perimeter openings 56 using the wand 50 but again, there is no limitation in this regard and the playing pieces could equally be moved inwardly from the openings 56 to the openings 54.

FIGS. 7 to 10 illustrate an alternative embodiment of the invention in which two games of the form disclosed with reference to FIGS. 1 to 5 are coupled together for competitive play.

Figure 7:
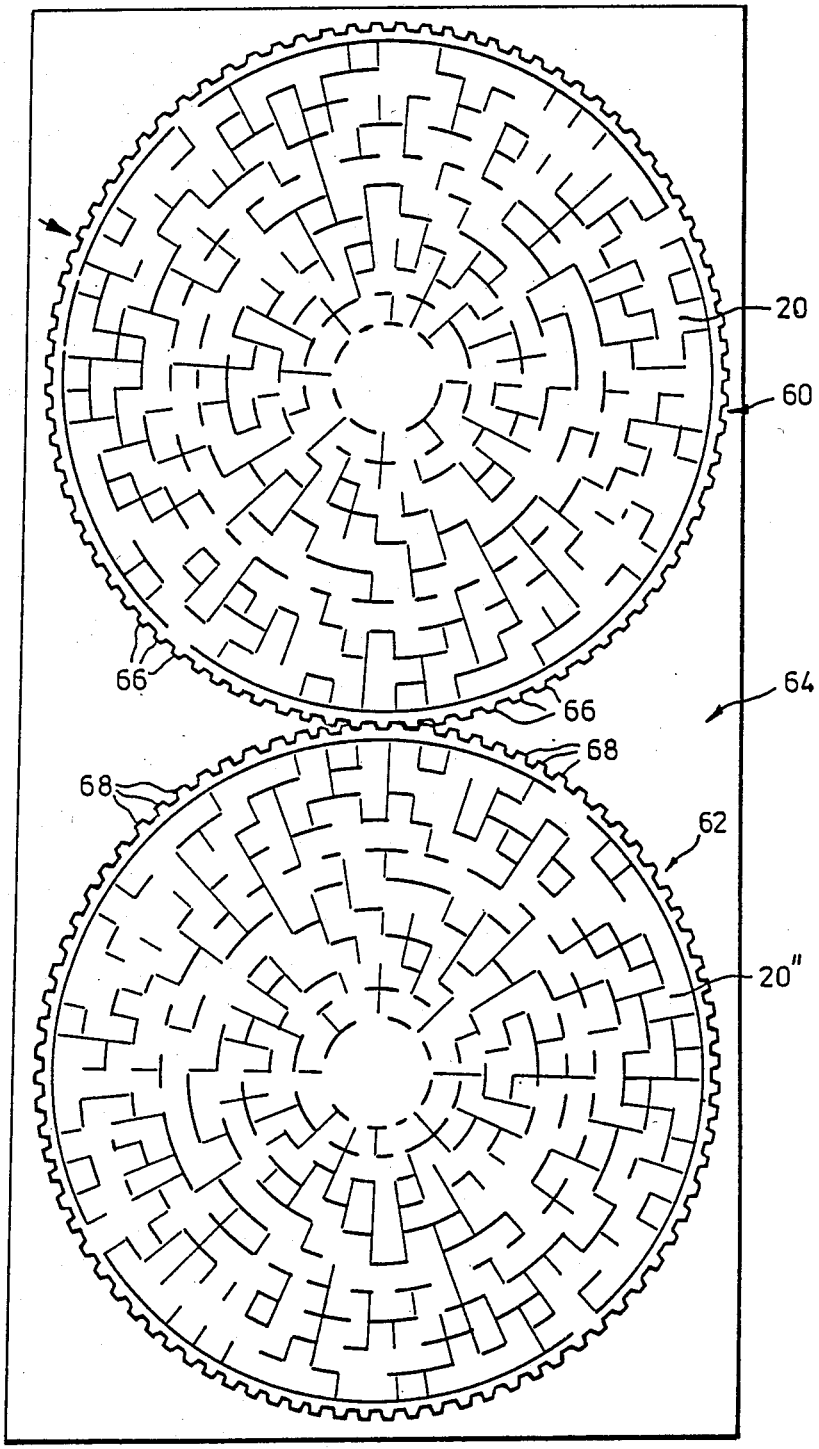
FIG. 7 is an elevational view of an alternative embodiment of the invention in which two similar games are provided and are coupled together for permitting competitive play between two players.

Referring first to FIG. 7 the two games are individually denoted by reference numerals 60 and 62 and are mounted on a common base board 64. Each game 60 and 62 comprises two plates each carrying an array of wall elements which co-operate to define a maze generally as described above. As seen in FIG. 7, the top plates of the two games are visble in plan and the wall elements can be seen through the plates. The top plates are individually denoted by reference numeral 20′ in the case of game 60 and 20″ in the case of game 62. Each of the plates 20′ and 20″ is a circular disc having a series of spaced vertical ribs or teeth around its periphery; the teeth are denoted by reference numeral 66 in the case of plate 20′ and by numeral 68 in the case of plate 20″. The games are secured to the base board 64 at a spacing such that the respective ribs or teeth 66 and 68 mesh with one another; accordingly, the two plates 20′ and 20″ are effectively coupled together in the manner of gear teeth so that when one of the plates is turned the other plate will turn in unison but in the opposite direction. The wall elements carried by the upper and lower plates of the respective games will be arranged so that the defined positions of the two games at which predetermined maze paths are formed will coincide. The paths may be the same or different.

In any event, the intention is that the two games will permit players to compete against one another at the same time. The playing pieces will be inserted simultaneously into the two mazes and the player who brings his or her playing piece to one of the peripheral openings first is the winner.

Figure 8:
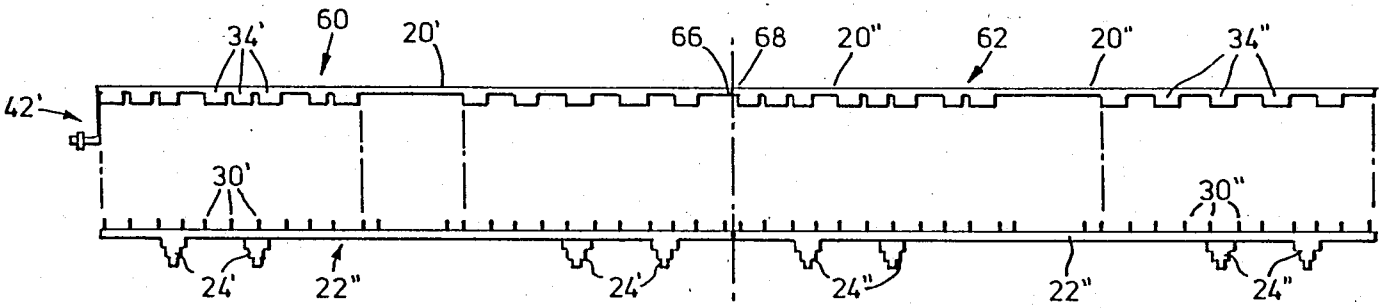
FIG. 8 is an elevational view in the direction of arrow A in FIG. 7, showing the upper and lower plates of the respective games in exploded positions, generally similar to FIG. 2.
Figure 9:
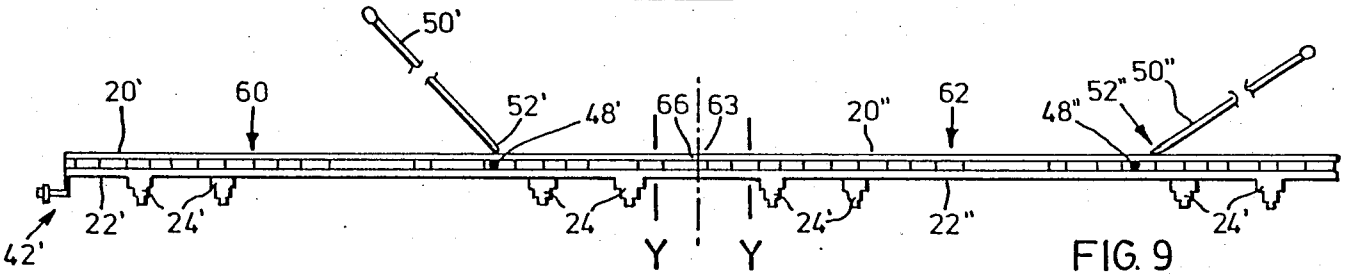
FIG. 9 is a view similar to FIG. 8 showing the games assembled and in use; and, FIG. 10 is an enlarged sectional view of part of FIG. 9.
Figure 10:
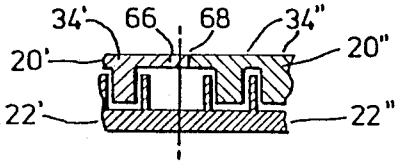

FIGS. 8, 9 and 10 are views generally similar to FIGS. 2, 3 and 4 but showing the embodiment of the game illustrated in FIG. 7. Parts which correspond with parts shown in FIGS. 2, 3 and 4 are indicated with primed reference numerals in the case of game 60 and double primed reference numerals in the case of game 62.

Differences as compared with the first embodiment are that only a single latch 42′ is provided because it is necessary to latch the upper plate of only one of the two games in a selected position in which a maze is defined through the game; the upper plate of the other game will automatically be held stationary because of the fact that it is "geared" to the first game. Another difference is that the timer 32 of the first embodiment has been omitted in the embodiment of FIGS. 7 to 10. In the latter case, a plain boss 36′ and 36″ is provided at the center of each game.

It will of course be understood that the preceding description relates to particular preferred embodiments of the invention only and that many modifications are possible but in the broad scope of the invention. For example, at least in the first embodiment, the upper and lower plates of the game need not necessarily be circular discs. Also, as indicated previously, only the upper plate of the game need be transparent. One or both of the discs could be designed to be turnable to provide different paths through the maze. Preferably, each disc and the associated wall element is formed as a single plastic moulding although again this is not essential. The magnetic "wand" and ferromagnetic playing piece arrangement could of course be reversed with the playing piece being magnetic and the tip of the wand made of a ferromagnetic material.

In the embodiments described above, each game is provided with three openings 56 through which a playing piece can enter or leave a maze. As discussed previously, the playing pieces will normally leave through the openings 56 and in which case the openings can be considered as "exit openings". Each of these openings serves as the exit opening for at least one of the mazes and in fact in the described embodiment, each serves as the exit opening for more than one maze, although there is no limitation in this respect. Preferably, no indication is given to the player of which opening is the appropriate exit for a particular maze since it is believed that this will enhance the play appeal of the game. In an alternative embodiment, more than one exit opening could be provided for each maze. Conversely, the game could be provided with a single exit opening for all of the mazes in the game.

I claim:

1. A game including a maze through which playing pieces can be moved between a central location and at least one outer location, comprising: upper and lower plates supported for relative turning movement in generally parallel planes about an axis generally at said central location, the lower plate being stationary and the upper plate being turnable with respect to the lower plate; respective arrays of wall elements at inner surfaces of the plates co-operating to define said maze, the wall elements on one of said plates being arranged in spaced concentric annular rows about said axis and the wall elements of the other plate extending generally radially between said annular rows of wall elements, the wall elements being arranged to define a plurality of different paths through the maze in respectively different predetermined relative positions of the plates about said axis; a wand having a tip; a playing piece which is magnetically attractable to said tip for permitting manipulation of the playing piece through the maze by drawing the tip of the wand across said upper plate, said plate being at least partially transparent; and, timer means carried by one of said plates and operable from externally of the game to permit timing of attempts to move a playing piece through the maze; said lower plate including a boss at said central location and the upper plate including a central opening co-operating with said boss so that said upper plate is supported at a clearance from the lower plate on said boss, said timer means being carried by said boss and protruding through said opening in the upper plate.

2. A game as claimed in claim 1, further comprising detent means between said plates and adapted to locate the plates relative to one another in each of said predetermined relative positions of the plates about said axis.

3. A game as claimed in claim 2, wherein said detent means comprise a flexible latch member carried by one of said plates and peripheral recesses in the other of said plates corresponding to the predetermined relative positions of the plates about said axis, for receiving said latch member.

4. A game as claimed in claim 1, wherein said lower plate is provided with means for supporting the plate in a stationary position on a support surface and wherein said upper plate is turnable with respect to the lower plate to define said relative positions of the plates.

5. A game as claimed in claim 1, wherein each of said plates and the associated array of wall elements is defined by a unitary plastic moulding.

6. The combination of two games each including:

a maze through which playing pieces can be moved between a central location and at least one outer location, comprising: upper and lower plates supported for relative turning movement in generally parallel planes about an axis generally at said central location; respective arrays of wall elements at inner surfaces of the plates co-operating to define said maze, the wall elements on one of said plates being arranged in spaced concentric annular rows about said axis and the wall elements of the other plate extending generally radially between said annular rows of wall elements, the wall elements being arranged to define a plurality of different paths through the maze in respectively different predetermined relative positions of the plates about said axis; a wand having a tip; and a playing piece which is magnetically attractable to said tip for permitting manipulation of the playing piece through the maze by drawing the tip of the wand across said upper plate, said plate being at least partially transparent;

said games being supported on a common base with the said lower plates adapted to remain stationary on the base and the upper plates turnable with respect to the base about generally parallel turning axes, wherein the upper plates of the respective games are provided with peripheral series of teeth and the games are positioned on said base with the teeth in mesh so that turning of the upper plate of one game turns the upper plate of the other game, the wall elements of the respective games being arranged so that in each of said predetermined relative positions of the plates of one of said games about its said axis, the wall elements of the other game are arranged to define a path through the maze of that game, each said game including a said wand and magnetically attractable playing piece.

7. The invention defined claim 6, wherein one of said games is provided with detent means for locating the plates of that game relative to one another in said predetermined relative positions of the plates, the plates of the other game being similarly located by virtue of the co-operation between the upper plates of the respective games.

* * * * *